United States Patent [19]

Snyder

[11] Patent Number: 4,785,958

[45] Date of Patent: Nov. 22, 1988

[54] TANK WITH SLOPED BOTTOM

[75] Inventor: Andrew W. Snyder, Beatrice, Nebr.

[73] Assignee: Hoover Group, Inc., Roswell, Ga.

[21] Appl. No.: 174,134

[22] Filed: Mar. 28, 1988

[51] Int. Cl.[4] ..... B65D 87/00

[52] U.S. Cl. ..... 220/5 A; 220/1.5; 220/66; 220/DIG. 6

[58] Field of Search ..... 220/5 A, 1.5, 66, DIG. 6, 220/1 B, 1 C

[56] References Cited

U.S. PATENT DOCUMENTS

| | | | |
|---|---|---|---|
| 1,430,000 | 9/1922 | Bell | 220/66 |
| 2,887,251 | 5/1959 | Mackridge | 220/1.5 X |
| 4,157,609 | 6/1979 | Schutz | 220/1.5 X |
| 4,173,288 | 11/1979 | Schutz | 220/1.5 |
| 4,557,406 | 12/1985 | Olinger et al. | 220/DIG. 6 X |
| 4,648,521 | 3/1987 | Thomas et al. | 220/5 A X |
| 4,746,034 | 5/1988 | Ata et al. | 220/1.5 X |

*Primary Examiner*—Steven M. Pollard

*Attorney, Agent, or Firm*—Harness, Dickey & Pierce

[57] ABSTRACT

A portable tank has a sloped bottom structure with a smooth internal bottom surface sloping along a single bend toward a bottom discharge opening in the bottom plate. The sloped bottom structure has upturned curved side portions merging with upwardly extending wall portions joining the vertical walls of the tank along a horizontal edge. The bottom structure is formed by forming a discharge opening in a flat bottom plate near one edge, forming a gap between the opening and the edge which diverges from the gap toward the edge, bending the sides of the plate upwardly, and bringing the side of the gap together to mate in a closed seam bowing the bottom of the plate outward at the opening to slope the bottom towards the discharge opening.

3 Claims, 2 Drawing Sheets

TANK WITH SLOPED BOTTOM

BACKGROUND AND SUMMARY OF THE INVENTION

This invention relates generally to portable tanks and more particularly to a sloped bottom structure of a portable tank adapted for liquid storage and transport.

A large tank for liquid storage generally has a bottom discharge. The construction of a tank having a bottom discharge generally requires affixing legs to the bottom of the tank so as to raise the discharge opening from the ground or the supporting surface upon which the tank rests. In order to provide complete drainage of tank contents, without requiring tipping of the tank, has often required difficult and complex bottom structures.

It is more convenient to connect hoses and fittings from the side of the bottom rather than trying to reach a central discharge underneath the bottom of a large tank or bin. However, conventional side discharge construction has also been proven to be difficult.

It is therefore desirable to provide a portable tank having a sloped bottom structure that presents a smooth interior surface sloped toward the discharge opening to allow full drainage from the tank. Such a portable tank having a sloped bottom structure is disclosed in my copending application Ser. No. 144,376, filed Jan. 15, 1988, commonly assigned.

In this copending application a sloped bottom is described requiring a plurality of bends in the bottom to produce the slope. It is an object of the present invention to provide a sloped bottom structure for a portable tank having simplified construction formed from a single sheet of plate material without a formed bend being required to produce the slope.

A portable tank having a sloped bottom structure according to the present invention has a generally rectangular bottom plate having a discharge opening therethrough. A single bend directed toward the bottom discharge opening in the plate forms the sloped inner surface of the bottom. The sides of the generally rectangular bottom plate are upwardly curved so as to merge with upwardly extending side wall portions of the plate which terminate in a substantially horizontal edge. This edge joins with vertical side walls of the tank.

The bottom structure has four feet, each positioned adjacent a corner of the generally rectangular plate. These feet are hollow elliptical cylinders and may be formed from sheet metal stock. Each foot has a horizontal bottom edge and a sculptured upper edge which is contoured to match the curvature of the bottom plate. The feet position the discharge opening at the lowest elevation of the bottom plate when the feet rest on a horizontal surface and the upper edge of the bottom plate is in a horizontal plane.

The sloped bottom of the present invention has a closed seam connecting the edge with the discharge opening which is formed from a divergent gap in the plate extending from the opening to the edge of the plate. This gap converges at the discharge opening so that when the gap is closed, the bottom plate at the discharge opening is moved downwardly thereby positioning the opening at the lowest point in the plate. Liquid in the tank will drain by gravity flow in the bend and along the bend to the discharge opening to ensure complete drainage of the tank contents without the necessity of tipping the tank.

The sloped bottom of the present invention is simply formed by taking a flat rectangular piece of material such as plate aluminum or steel and drilling, stamping, or otherwise forming a discharge opening through the plate near one edge, cutting or stamping a divergent gap in the plate running between the opening and the nearest edge of the plate, bending the sides of the plate upward to form upwardly extending wall portions, and bringing the sides of the gap together so as to mate in a closed seam. The bringing together of the sides of the gap bows the bottom of the plate outward at the discharge opening which essentially moves the discharge opening downward while at the same time positioning the edges of the upwardly extending wall portions of the plate in a substantially horizontal plane.

The sloped bottom thereby formed may be enhanced by pressing or stamping a single bend which radiates from the opening away from the nearest edge so that liquid in the tank will drain into the bend and then be channeled along the bend to the discharge opening.

Further objects, features, and advantages of the invention will become evident from a consideration of the following detailed description when taken in conjunction with the accompanying drawing and the appended claims.

DETAILED DESCRIPTION OF THE INVENTION

Figure 1:
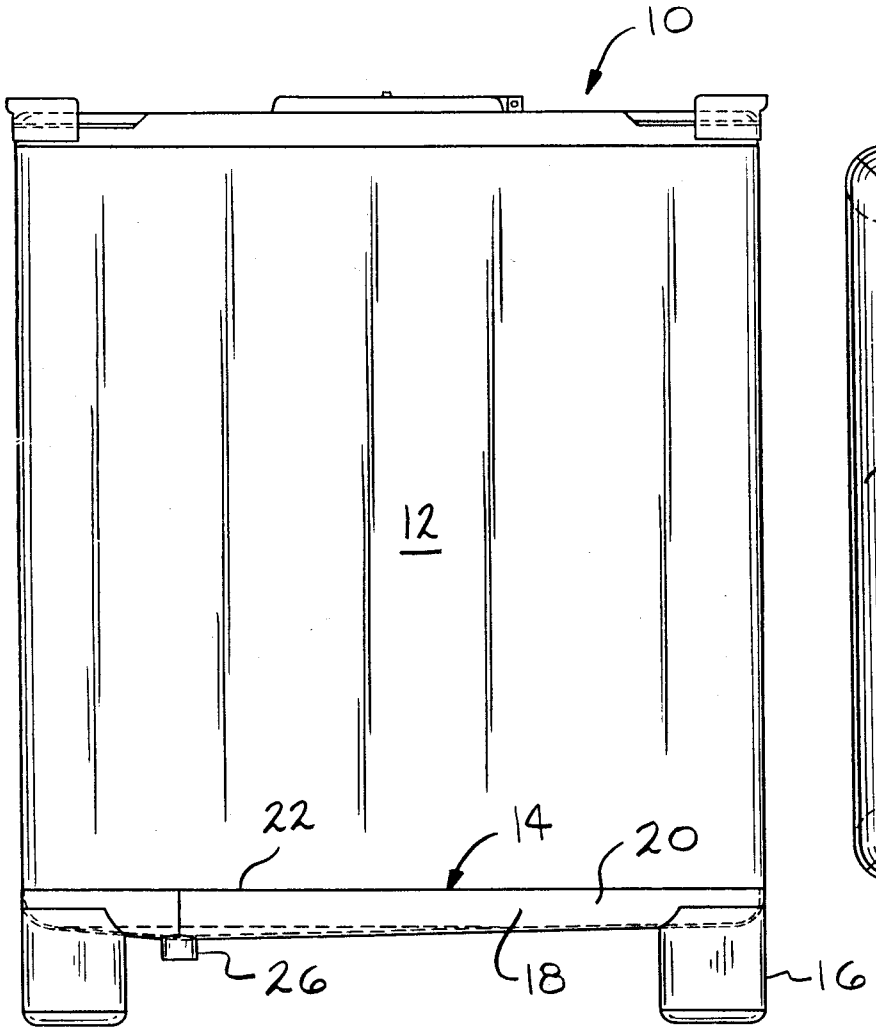
FIG. 1 is a side view of a portable tank having a sloped bottom according to the present invention.

Turning now to the drawing, a portable tank 10 for bulk liquid storage and transport according to the present invention is shown in FIG. 1. Tank 10 includes generally vertical side walls 12 and a sloped bottom structure 14. Feet 16 are fixed to the corners of sloped bottom structure 14.

Figure 2:
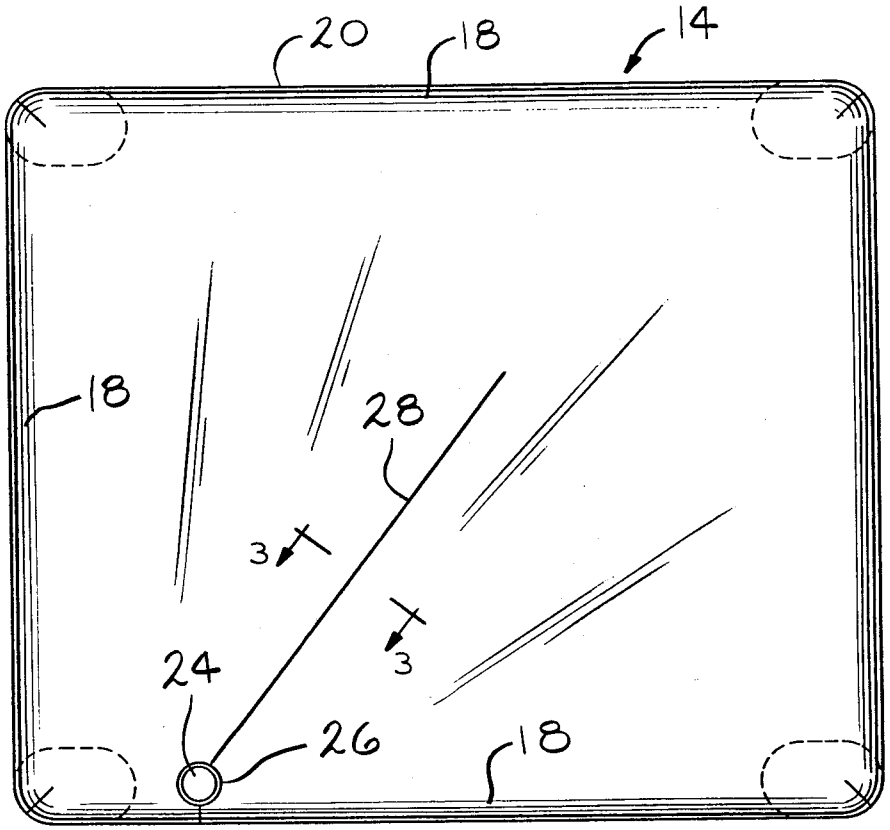
FIG. 2 is a top view of the sloped bottom of the portable tank shown in FIG. 1.

Sloped bottom structure 14 has upturned side portions 18 that merge with upwardly extending wall portions 20 that terminate in a substantially horizontal upper edge 22. As shown in FIGS. 1 and 2, discharge opening 24 is positioned adjacent one of upturned side portions 18 and has tubular nipple 26 welded thereto. Tubular section 26 may be a valve, threaded fitting, or other discharge fixture as appropriate for the particular installation.

As shown in FIG. 2, bottom structure 14 also includes a bend 28 which radiates from discharge opening 24. Bend 28 directs gravity drainage of the liquid in tank 10 first towards bend 28 and then along the axis of bend 28 to discharge opening 24 for complete drainage.

Figure 4:
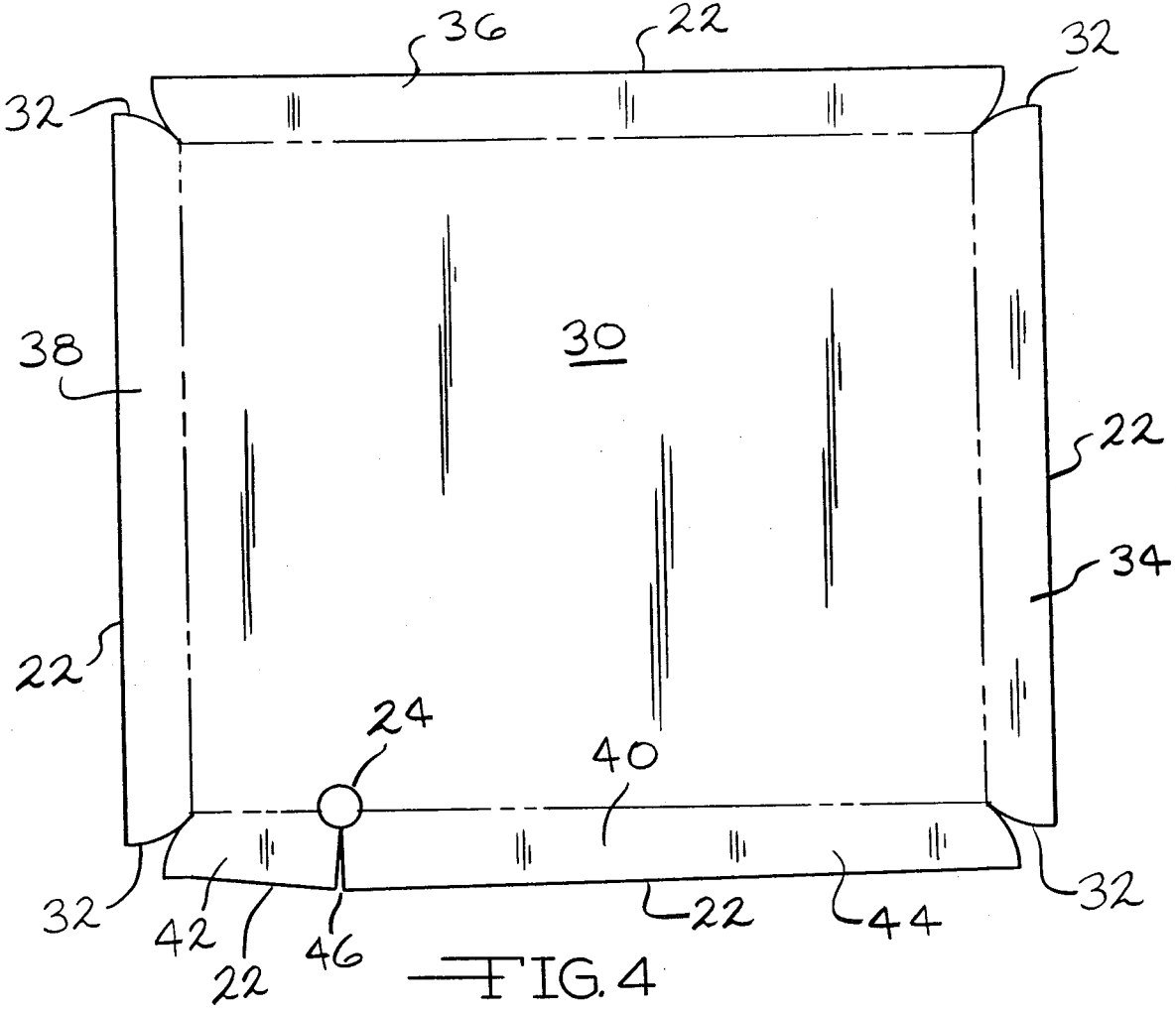
FIG. 4 is a top view of the bottom plate stamping prior to bending of the sides to form the sloped bottom.
Figure 3:
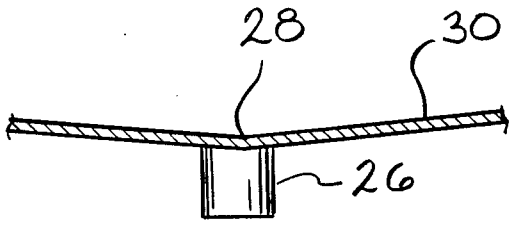
FIG. 3 is a partial sectional view of the sloped bottom structure along the line 3—3 in FIG. 2.

The flat plate utilized to form sloped bottom structure 14 according to the present invention is shown in FIG. 4. Plate 30 is basically a rectangular plate having curved cutouts 32 at the corners. The edges of cutouts 32 are brought together by the bending upward of sides 34, 36, 38 and 40 to form the upturned side portions 18 that merge with upwardly extending wall portions 20.

As shown in FIG. 4, the side 40 adjacent the discharge opening 24 is comprised of portions 42 and 44 separated by a gap 46 which diverges from opening 24 toward edge 22 of side portion 40. The portion of edge 22 on side portion 44 is not parallel to edge 22 on opposite side 36 so that side portion 44 is wider at the gap 46 than at the opposite end. Similarly, side portion 42 is wider at the gap 46 than at the opposite end so that its edge 22 is also not parallel to edge 22 on opposite side 36.

Formation of the discharge opening 24, gap 46, and corner cutouts 32 may be done sequentially or integrally with the cutting or stamping of the flat plate 30. When sides 34, 36, 38, and 40 are bent upward, sides 34, 36, and 38 will be positioned with edges 22 in a substantially horizontal plane. Side 40 however will have a slightly raised portion above this plane, peaking at gap 46. When portions 42 and 44 are brought together so as to close gap 46 forming a closed seam, opening 24 will be pushed downward and outward to form the sloped bottom as shown in FIG. 1. In addition, the closing of gap 46 will bring edge 22 of portions 42 and 44 into alignment with the other edges 22 of sides 34, 36, and 38 such that edge 22 of side 40 will also lie in the plane of edges 22 on sides 34, 36, and 38.

Each corner will then have a closed seam. The edges of the closed seams at the corners and between opening 24 and edge 22 are then each welded together to complete the sloped bottom structure 14 of the tank shown in FIG. 1. In addition, a bend 28 formed in the bottom as shown in FIG. 2 further acts to slope the bottom in a direction towards discharge opening 24.

Bottom structure 14 so formed may then be welded or otherwise attached to sides 12 to form the portable tank 10 as shown in FIG. 1.

The sloped bottom structure 14 of the present invention therefor forms a smooth inner surface to the tank bottom so as to provide complete drainage of tank contents without the potential for residual pockets of liquid within the tank. In addition, the bottom structure 14 so formed may be comprised of basically three sequential operations: that of stamping bottom 30 having a desired flat shape and bending the sides upward, and bringing the sides of the gaps together to mate in a closed seam to form the bottom sloping towards the discharge opening. This simplified constuction reduces cost and assembly time in an advantageous manner.

The invention has been described above in an illustrative manner and it is to be understood that terminology which has been used is intended to be in the nature of word of description rather than of limitation. Obviously many modifications and variations of the present invention are possible in light of the above teachings. It is therefore to be understood that within the scope of the appended claims, the invention may be practiced otherwise than as specifically described.

What is claimed is:

1. A portable tank for liquid storage and transport having generally vertical sides and a sloped bottom for complete drainage of fluid from the tank, said bottom having upturned side portions that merge with upwardly extending wall portions terminating in a substantially horizontal upper edge, said bottom comprising:

a generally flat, rectangular bottom plate having a plurality of edges;

a discharge opening through said bottom plate near one of said edges;

a bend in said bottom plate radiating from said discharge opening in a direction extending away from said one edge;

a closed seam connecting said one edge with said opening, said seam formed from a divergent gap in the plate extending from the opening to said one edge, said gap converging at the opening so that when the gap is closed the bottom plate at the opening is moved downwardly to position said opening at the lowest point in said plate whereby liquid in said tank will be caused by gravity to flow into said bend and along said bend to said discharge opening to cause complete drainage of the tank contents without tipping of the tank.

2. The method of forming the bottom in a portable tank for liquid storage and transport having generally vertical sides and a sloped bottom for complete drainage of fluid from the tank, said bottom having upturned side portions that merge with upwardly extending wall portions terminating in a substantially horizontal upper edge, said method comprising the steps of:

a. providing a generally flat, rectangular bottom plate having side portions and a plurality of edges;

b. forming a discharge opening through said bottom plate near one of said edges;

c. forming a gap in said plate having divergent sides extending from said one edge to said discharge opening, the sides of said gap converging at said opening and diverging at said one edge;

d. bending said side portions upward to form said upwardly extending wall portions; and e. bringing the sides of said gap together to mate in a closed seam thereby bowing said bottom plate outward to slope said bottom downward toward said discharge opening and position the edges of said upwardly extending wall portions in a substantially horizontal plane.

3. The bottom according to claim 2 wherein said bottom is formed by the further step of pressing a radial bend in said plate, said bend radiating from said opening in a direction extending away from said one edge, said radial bend directing the fluid in said tank toward said opening.

* * * * *